US008959880B2

(12) United States Patent
Morand

(10) Patent No.: US 8,959,880 B2
(45) Date of Patent: Feb. 24, 2015

(54) FILM-DISPENSING CASSETTE AND RIMMED BAG FOR WASTE-DISPOSAL UNIT

(75) Inventor: Michel Morand, Montréal (CA)

(73) Assignee: International Refills Company Limited (BB)

( * ) Notice: Subject to any disclaimer, the term of this patent is extended or adjusted under 35 U.S.C. 154(b) by 197 days.

(21) Appl. No.: 13/272,383

(22) Filed: Oct. 13, 2011

(65) Prior Publication Data

US 2012/0091295 A1 Apr. 19, 2012

Related U.S. Application Data

(60) Provisional application No. 61/392,603, filed on Oct. 13, 2010, provisional application No. 61/412,614, filed on Nov. 11, 2010.

(30) Foreign Application Priority Data

Jan. 7, 2011 (CA) ..... 2726926

(51) Int. Cl.
*B65B 9/10* (2006.01)
*B65B 43/26* (2006.01)
(Continued)

(52) U.S. Cl.
CPC ..... *B65F 1/062* (2013.01); *B65B 2067/1283* (2013.01); *B65F 1/002* (2013.01);
(Continued)

(58) Field of Classification Search
USPC ..... 248/99; 206/303, 397, 409; 53/567, 53/570, 571, 390, 576, 549, 436, 469, 574, 53/459, 526; 220/495.05–495.08, 495.11, 220/908, 908.1
See application file for complete search history.

(56) References Cited

U.S. PATENT DOCUMENTS 2,671,906 A 3/1954 Potts
3,536,192 A * 10/1970 Couper ..... 206/303
(Continued)

FOREIGN PATENT DOCUMENTS

CA 2366384 A1 6/2003
CA 2532230 A1 10/2006
CA 2518325 A1 3/2007

OTHER PUBLICATIONS

International Search Report; International Application No. PCT/CA2011/050637; International Application Filing Date Oct. 11, 2011; Mail Date Jan. 17, 2012.
CA office action for corresponding Application No. 2,726,926; Report date Jan. 24, 2013.

*Primary Examiner* — Christopher Garft
(74) *Attorney, Agent, or Firm* — Cantor Colburn LLP

(57) ABSTRACT

A film-supporting device is used with a waste-disposal unit. The device comprises an annular body. The annular body has an annular wall. The inward radial surface of the wall defines a central opening of the body. The outline of the central opening in a transverse plane of the device has variable diametrical dimensions with a first diameter of greater dimension than the second diameter. The outline has two of the first diameter of generally equal dimension and two of the second diameter of generally equal dimension. The device has tubular film about an outward radial surface of the annular body. A free annular end is dispensed outwardly from the annular wall. The free annular end is closed to form a bag. The opening of the bag is accessible through the central opening and is of optimized shape via the central opening for the disposal of waste. A method for disposing of waste on a scooping tool is also provided.

12 Claims, 8 Drawing Sheets

(51) Int. Cl.

| | |
|---|---|
| ***B65D 25/14*** | (2006.01) |
| ***B65D 35/14*** | (2006.01) |
| ***B65F 1/06*** | (2006.01) |
| ***B65F 1/00*** | (2006.01) |
| *B65B 67/12* | (2006.01) |

(52) U.S. Cl.

CPC ..... *B65B67/1222* (2013.01); *B65F 2240/132* (2013.01); *Y10S 220/908* (2013.01); *Y10S 220/9081* (2013.01)

USPC ..... 53/567; 53/570; 53/571; 53/390; 53/576; 53/436; 53/469; 53/574; 53/459; 53/526; 248/99; 206/303; 206/397; 206/409; 220/495.05; 220/495.06; 220/495.07; 220/495.08; 220/908; 220/908.1

(56) References Cited

U.S. PATENT DOCUMENTS

| | | | | |
|---|---|---|---|---|
| 4,238,868 | A | 12/1980 | Sternberg | |
| 4,577,778 | A | 3/1986 | Kim | |
| 4,712,701 | A * | 12/1987 | Durkan, Jr. | 220/649 |
| 5,590,512 | A | 1/1997 | Richards et al. | |
| 5,813,200 | A | 9/1998 | Jacoby et al. | |
| 6,401,967 | B1 * | 6/2002 | Rabe et al. | 220/796 |
| 6,974,029 | B2 * | 12/2005 | Morand et al. | 206/303 |
| 2002/0162304 | A1 | 11/2002 | Stravitz | |
| 2002/0170275 | A1 * | 11/2002 | Salman et al. | 53/459 |
| 2006/0010837 | A1 * | 1/2006 | Jurus | 53/436 |
| 2008/0272140 | A1 * | 11/2008 | Mowers et al. | 221/69 |

* cited by examiner

FILM-DISPENSING CASSETTE AND RIMMED BAG FOR WASTE-DISPOSAL UNIT

CROSS-REFERENCE TO RELATED APPLICATION(S)

The present application claims priority on U.S. Provisional Patent Application No. 61/392,603, filed on Oct. 13, 2010, U.S. Provisional Patent Application No. 61/412,614, filed on Nov. 11, 2010, and Canadian Patent Application No. 2,726,926, filed on Jan. 7, 2011, all incorporated herein by reference.

FIELD OF THE APPLICATION

The present application relates to film-dispensing cassettes and rimmed bags of the type supported at an opening of a waste-disposal unit and dispensing tubular film in the form of a closed-end bag, or supporting such closed-end bag.

BACKGROUND OF THE ART

Waste-disposal units of the type having an internal mechanism used with a film-dispensing cassette are commonly used to throw away odorous waste, such as diapers and litter. In such waste-disposal units, the film-dispensing cassettes are supported at an opening of a bin and dispense tubular film projecting into the inner cavity of the bin of the waste-disposal unit. The free end of the tubular film is closed, thereby defining a bag. The internal mechanism in the waste-disposal unit presses the bag shut, thereby isolating the waste in the bag below the internal mechanism, and capturing the odors in the bag.

However, the refill cassettes are costly for the consumer, whereby it is desired to increase the amount of tubular film per cassette, without increasing drastically the dimensions of the cassette, for instance to be compatible with existing formats of waste-disposal units. By increasing the quantity of bag per cassette for similar dimensions, the transportation costs and shelving costs may also be reduced.

In some instances, it is desired to facilitate the disposal of the waste, for instance to reduce the amount of by-products such as dust created in the disposal.

SUMMARY OF THE APPLICATION

It is therefore an aim of the present disclosure to provide a novel film-dispensing cassette for waste-disposal unit.

It is a further aim of the present disclosure to provide a novel rimmed bag for waste-disposal unit.

It is a still further aim of the present disclosure to provide a novel method for dispensing waste in a film-dispensing cassette.

Therefore, in accordance with the present application, there is provided a film-supporting device for use with a waste-disposal unit comprising: an annular body having at least an annular wall, with an inward radial surface defining a central opening of the annular body, an outline of the central opening in a transverse plane of the device having variable diametrical dimensions with a first diameter being of greater dimension than a second diameter, the outline having in the transverse plane of the device two of the first diameter of generally equal dimension and two of the second diameter of generally equal dimension; and tubular film about an outward radial surface of the annular body, with a free annular end dispensed outwardly from the annular wall, the free annular end being adapted to be closed to form a bag with an opening of the bag being accessible through the central opening.

In accordance with another embodiment of the present disclosure, there is provided a film-supporting device for use with a waste-disposal unit comprising: an annular body having at least an inner annular wall and a radial wall projecting at least partially radially outwardly from the inner annular wall, with an inward radial surface defining a central opening of the annular body, an outline of an outer periphery of the annular body in a transverse plane of the device having variable diametrical dimensions with a first diameter being of greater dimension than a second diameter, the outline having in the transverse plane of the device two of the first diameter of generally equal dimension and two of the second diameter of generally equal dimension; and tubular film about an outward radial surface of the inner annular wall, with a free annular end dispensed outwardly from the inner annular wall, the free annular end being adapted to be closed to form a bag with an opening of the bag being accessible through the central opening.

DESCRIPTION OF THE PREFERRED EMBODIMENTS

Figure 7:
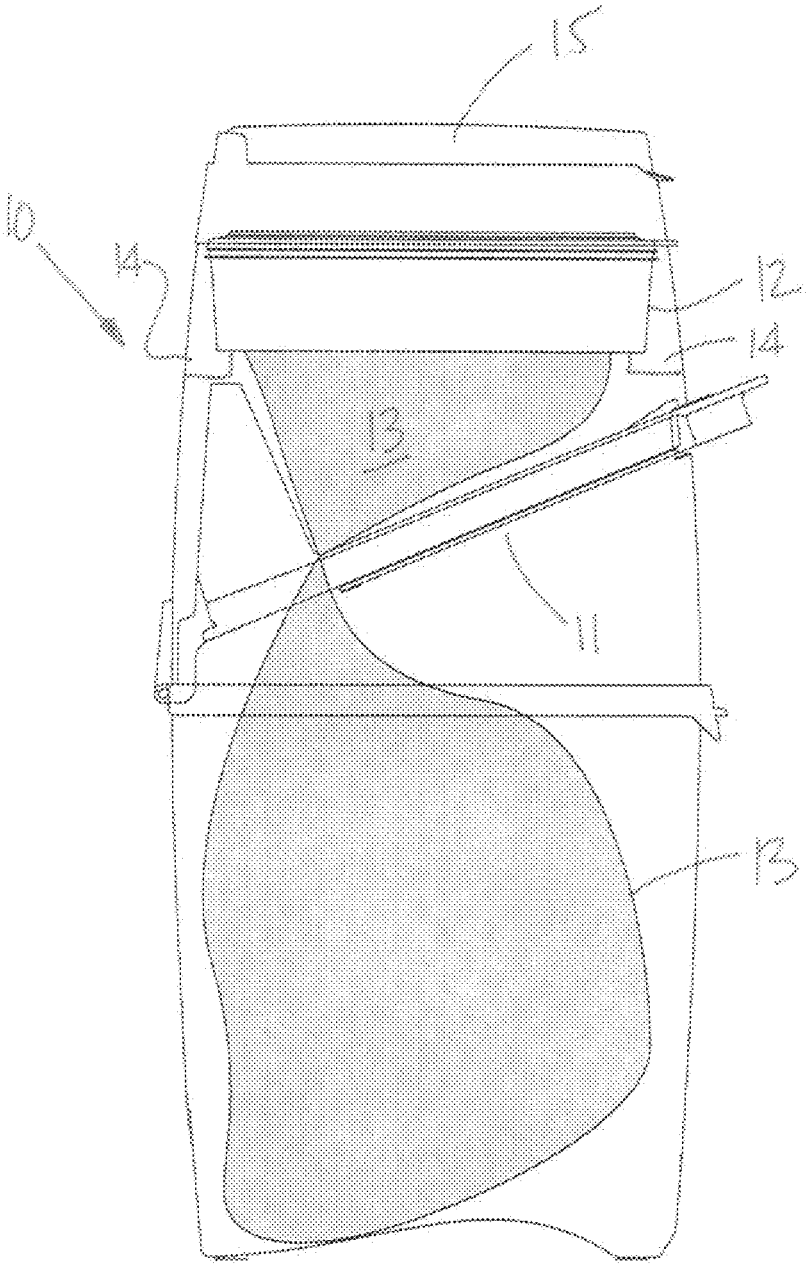
FIG. 7 is a schematic view of the film-dispensing cassette of FIG. 1 in a waste-disposal unit.

Referring to the drawings and more particularly to FIG. 7, there is illustrated a waste-disposal unit 10 of the type having a bag-closing mechanism 11 used with a film-dispensing cassette 12, recipient or cartridge (hereinafter cassette 12), or alternatively used with a rimmed bag 12' (described hereinafter for FIGS. 8 and 10). The waste-disposal unit 10 may be used for any type of waste items, but is well suited for the disposal of cat litter and hygienic items such as diapers. The waste-disposal unit 10 is shown as having a bin, but the waste-disposal unit 10 may have any other configuration capable of supporting the cassette 12 (such as a wire rack), and having the mechanism 11.

The cassette 12 is of the type having an annular shape with tubular film 13 dispensed from a top of the cassette 12, passing through the central opening of the cassette 12, and into the inner cavity of the waste-disposal unit 10. The free end of the tubular film 13 is closed, for instance with a knot 13A (shown in FIG. 2), to define a bag to receive the waste, with the central opening of the cassette 12 forming the opening of the bag. The free end of the tubular film 13 may be closed in any other suitable way, for instance by using a sealing unit to form a sealing joint at the free end of the tubular film 13. The mechanism 11 is actuatable to press the bag of the tubular film 13 shut, thereby keeping odors in the bag of the tubular film 13.

It is also possible to have the tubular film 13 dispensed from a bottom of the cassette 12, instead of being dispensed from the top. In such a case, the central opening of the cassette 12 defines the opening of the bag of tubular film 13.

The cassette 12 is therefore held by a support 14 adjacent to a top opening of the waste-disposal unit 10, above the mechanism 11. The support 14 may be of any possible shape or configuration to support the cassette 12. The tubular film 13 may be of any suitable material. In an embodiment, the tubular film 13 is made of a polymer, or numerous layers thereof. In another embodiment, the polymer is made of a barrier material generally odor-proof, such as EVOH. Moreover, the mechanism 11 may be a lid 15 sealingly secured to a top of the cassette 12 or to a top of the waste-disposal unit 10 to hold odors in the bag of the cassette 12.

Figure 1:
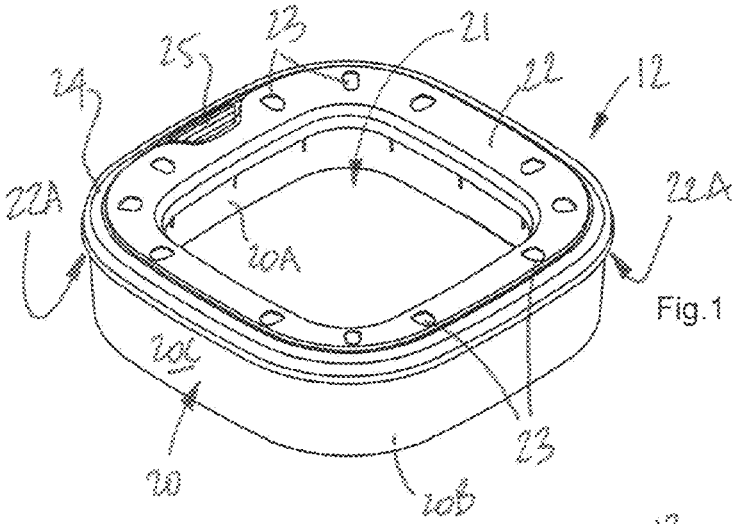
FIG. 1 is a perspective view of a film-dispensing cassette for waste-disposal unit, in accordance with an embodiment of the present disclosure.
Figure 2:
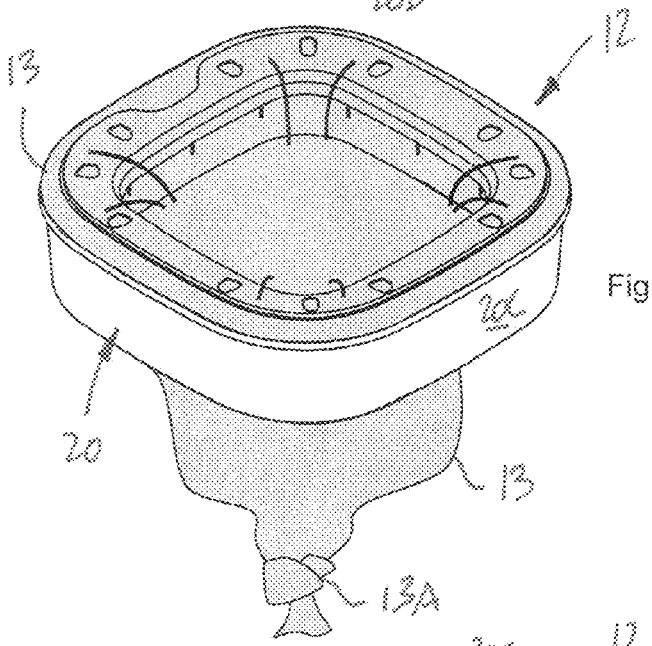
FIG. 2 is a perspective view of the film-dispensing cassette of FIG. 1, as dispensing film.
Figure 3:
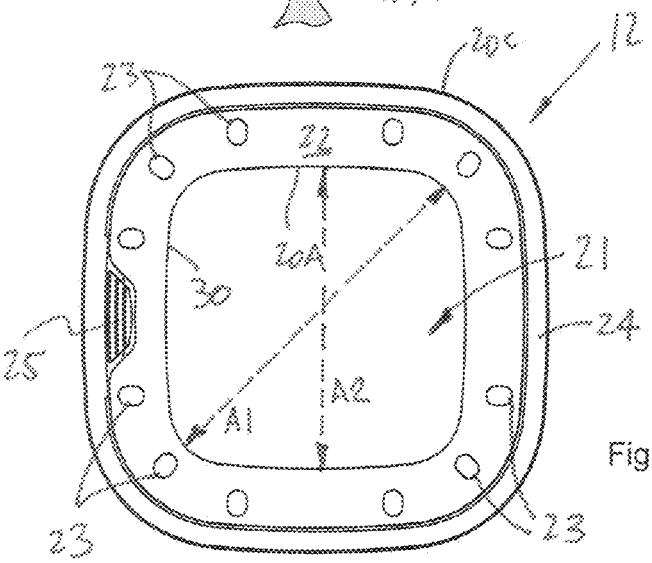
FIG. 3 is a top plan view of the film-dispensing cassette of FIG. 1.

Referring concurrently to FIGS. 1 to 3, the cassette 12 is shown in greater detail. The cassette 12 has an annular body 20 that is a recipient of the tubular film 13, held in an accumulated condition (e.g., pleated) radially outward of an inner annular wall 20A. The annular body 20 also has a bottom wall 20B, and may have an outer annular wall 20C, with the tubular film 13 being respectively on top of the bottom wall 20B and radially inward of the outer annular wall 20C. As explained hereinafter, the inner annular wall 20A, the bottom wall 20B and/or the outer annular wall 20C may be arranged to define clearances or the like.

The inner annular wall 20A also defines a central opening 21 of the annular body 20. As shown in FIG. 2, the tubular film 13 exits from a top of the annular body 20, and then projects below the annular body 20 by passing through the central opening 21. The closed end of the tubular film 13 is knotted at 13A, thereby forming a bag whose length is deployed from the cassette 12, until the bag is full.

Figure 4A:
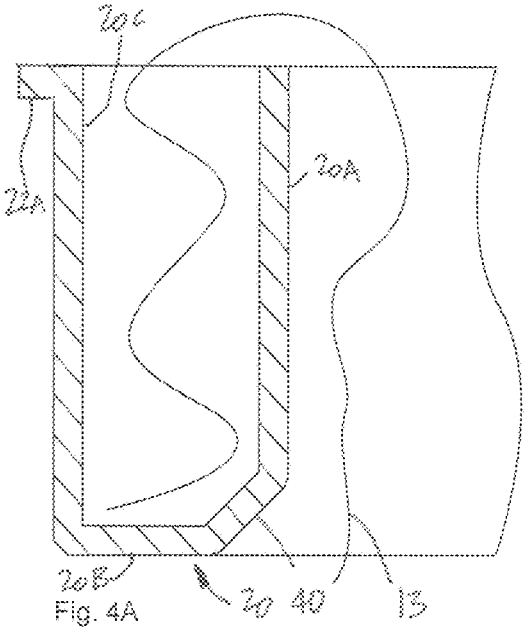
FIG. 4A is a sectional view of an annular body of the film-dispensing cassette of FIG. 1, with outer annular wall and with clearance.
Figure 4B:
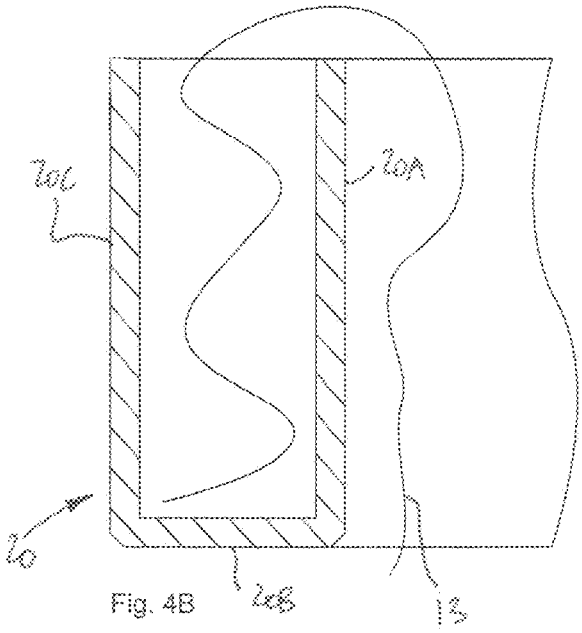
FIG. 4B is a sectional view of an annular body of the film-dispensing cassette of FIG. 1, with outer annular wall and without clearance.

Referring to FIGS. 1 to 3, a cover 22 is connected to a top edge of the inner annular wall 20A, and defines an outward flange with respect to the inner annular wall 20A, to help retain the tubular film 13 in the annular body 20 in the accumulated condition. The cover 22 may also/alternatively be connected to a top edge of the outer annular wall 20C if the cassette 12 has such a wall, or extend beyond the outer annular wall 20C to define a peripheral shoulder 22A. Alternatively, as shown in FIG. 4A, the peripheral shoulder 22A may be part of the annular wall 20C. From a plan view, the peripheral shoulder 22A projects radially beyond the bottom wall 20B or beyond the outer annular wall 20C. Moreover, the cassette 12 may not have the cover 22, with the tubular film 13 being retained solely by the inner annular wall 20A, or may only have a portion of a cover 22.

The cover 22 may have a plurality of throughbores 23. The throughbores 23 are provided to help press the accumulated tubular film 13 down with fingers contacting the film therethrough, while the cover 22 is being connected to the annular body 20. The cover 22 may be welded, glued, or mechanically retained to the annular body 20.

Referring to FIGS. 1 and 3, a tear-off strip 24 may be provided in the cover 22. The tear-off strip 24 is secured to a remainder of the cover 22 by a frangible joint, whereby a pulling action on tab 25 causes a rupture of the frangible joint and thus the removal of the strip 24. As shown in FIG. 2, the removal of the strip 24 defines a radial gap that exposes the tubular film 13, whereby a user may pull a free end of the accumulated tubular film 13 out of the annular body 20 to form a knotted bag, as explained above.

Figure 8:
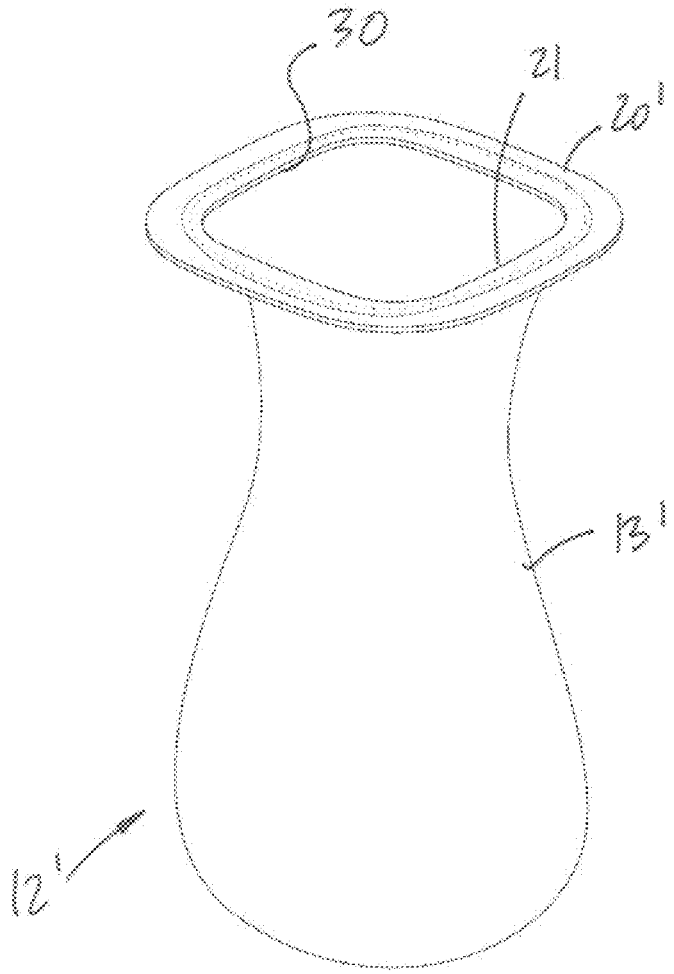
FIG. 8 is a schematic view of a rimmed bag in accordance with another embodiment.

Referring to FIG. 8, there is shown another embodiment of non-circular self-supported bag, in the form of a rimmed bag 12'. The rimmed bag 12' has several components in common with the cassette 12, whereby like numerals will refer to like elements. The rimmed bag 12' supports a closed-end bag 13' by way of an annular body 20'. The closed-end bag 13' is welded, glued, snapped or connected to the annular body 20' in any appropriate manner. Moreover, the bag 13' may simply be folded over the annular body 20' as shown in FIG. 10, without the necessity of welding or gluing the bag 13' to the annular body 20'. In FIG. 10, the annular body 20' is a square-sectioned tube.

In FIG. 8, the annular body 20' is shaped as a flat ring, and is made of a rigid or semi-rigid material, as it structurally supports a bag and its content. However, it may have other shapes, such as a cylinder (FIG. 10) or a circle of metallic wire. The annular body 20' has a central opening 21, by which an interior of the bag 13' is accessed. The annular body 20' may be constituted of a pair of parts foldable toward one another to seal the bag shut. Once the rimmed bag 12' is filled, it is discarded. Although not shown, the annular body 20' may have tabs on its periphery or connector holes adjacent the periphery, so as to be clipped or secured to a waste disposal unit.

Figure 10:
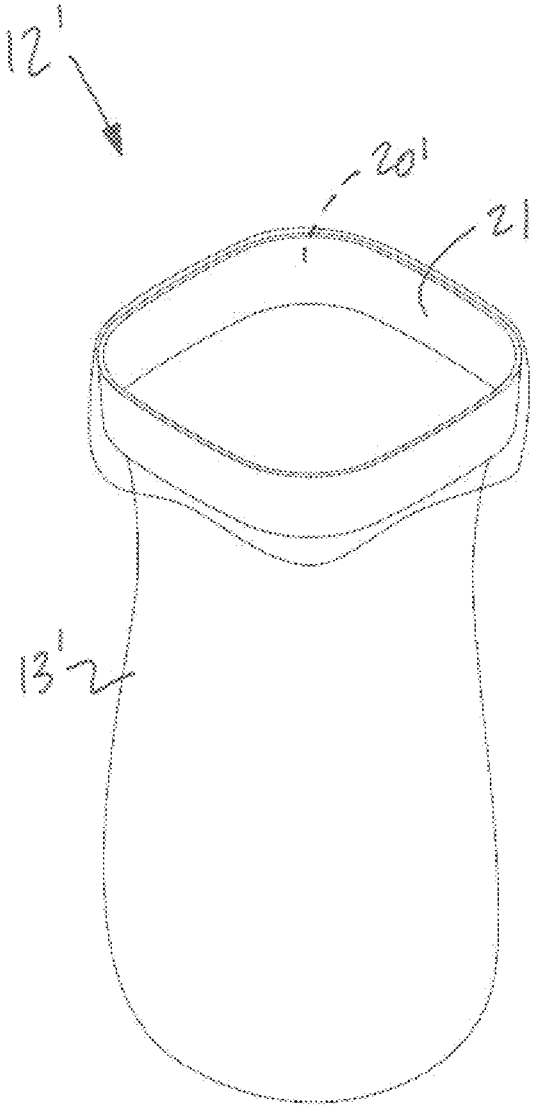
FIG. 10 is a schematic view of another rimmed bag in accordance with yet another embodiment.

Referring to FIG. 3, FIG. 8 and FIG. 10, the central openings 21 of the cassette 12 and of the rimmed bag 12' are shown having a generally square outline 30, with rounded corners. More specifically, the generally square outline 30 may be a squircle. Accordingly, the central opening 21 has at least one axial dimension (or diameter, axis, namely passing through the center of the outline shape) that is larger than another axial dimension, in a transverse plane of the cassette 12. This is shown as A1 being of greater dimension than A2 in FIG. 3 (A1>A2), in the transverse plane of the cassette 12. The generally square outline of the central opening 21 shown in FIG. 3 (i.e., not perfectly square because of the rounded corners), has two diagonals (represented by A2) of the same dimension, and two minimum widths (represented by A1) of the same dimension. It is observed that the outline of the outer periphery of the cassette 12 (as shown in FIG. 3) and the outline of the central opening 21 are similar figures.

Figure 6A:
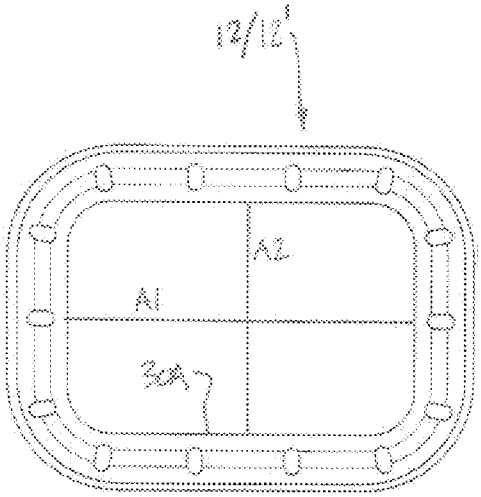
FIG. 6A is a top plan view of the film-dispensing cassette in accordance with another embodiment of the present disclosure, with a rectangular outline for central opening.
Figure 6B:
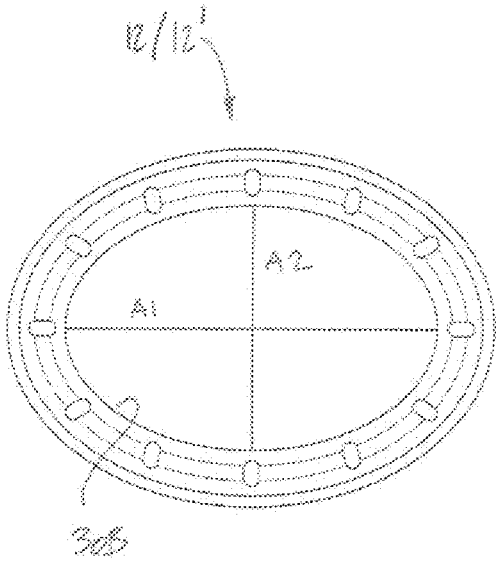
FIG. 6B is a top plan view of the film-dispensing cassette in accordance with another embodiment of the present disclosure, with an oval outline for central opening.
Figure 6C:
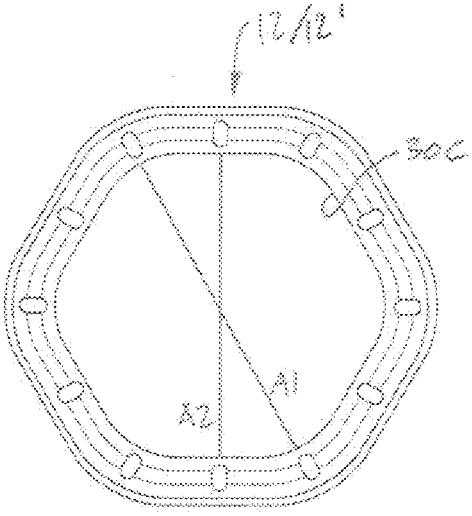
FIG. 6C is a top plan view of the film-dispensing cassette in accordance with another embodiment of the present disclosure, with a hexagonal outline for central opening.
Figure 6D:
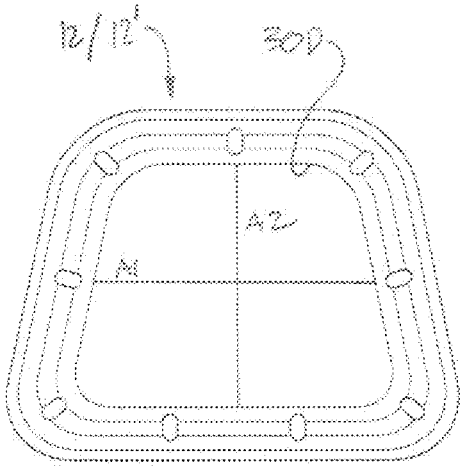
FIG. 6D is a top plan view of the film-dispensing cassette in accordance with another embodiment of the present disclosure, with a trapezoidal outline for central opening.

Referring to FIGS. 6A to 6D, other outlines respecting the rule A1>A2 are illustrated at 30A to 30D, for one or both of the contour of the central opening 21 and outer periphery of the cassette 12/rimmed bag 12'. The outlines 30A to 30D may be used as shapes for the central opening 21 and/or outer periphery of either one of the cassette 12 and rimmed bag 12', as may the outline 30 of FIG. 3. Other shapes are considered as well, such as super-ellipses and squircles (i.e., a specific type of super-ellipse). In an embodiment, it is preferred that the central opening 21 and/or outer periphery of the cassette 12 have an outline shape having at least two axes of symmetry in the transverse plane, such as the square outline 30 (FIG. 3), the rectangular outline 30A (FIG. 6A), the oval or elliptical outline 30B (FIG. 6B), and the hexagonal outline 30C (FIG. 6C). Other outlines with an A1>A2 outline and at least two axes of symmetry include octagonal outlines, decagonal outlines, and the like. The trapezoidal outline 30D of FIG. 6D does not have two axes of symmetry in the plan view (transverse plane).

Figure 5:
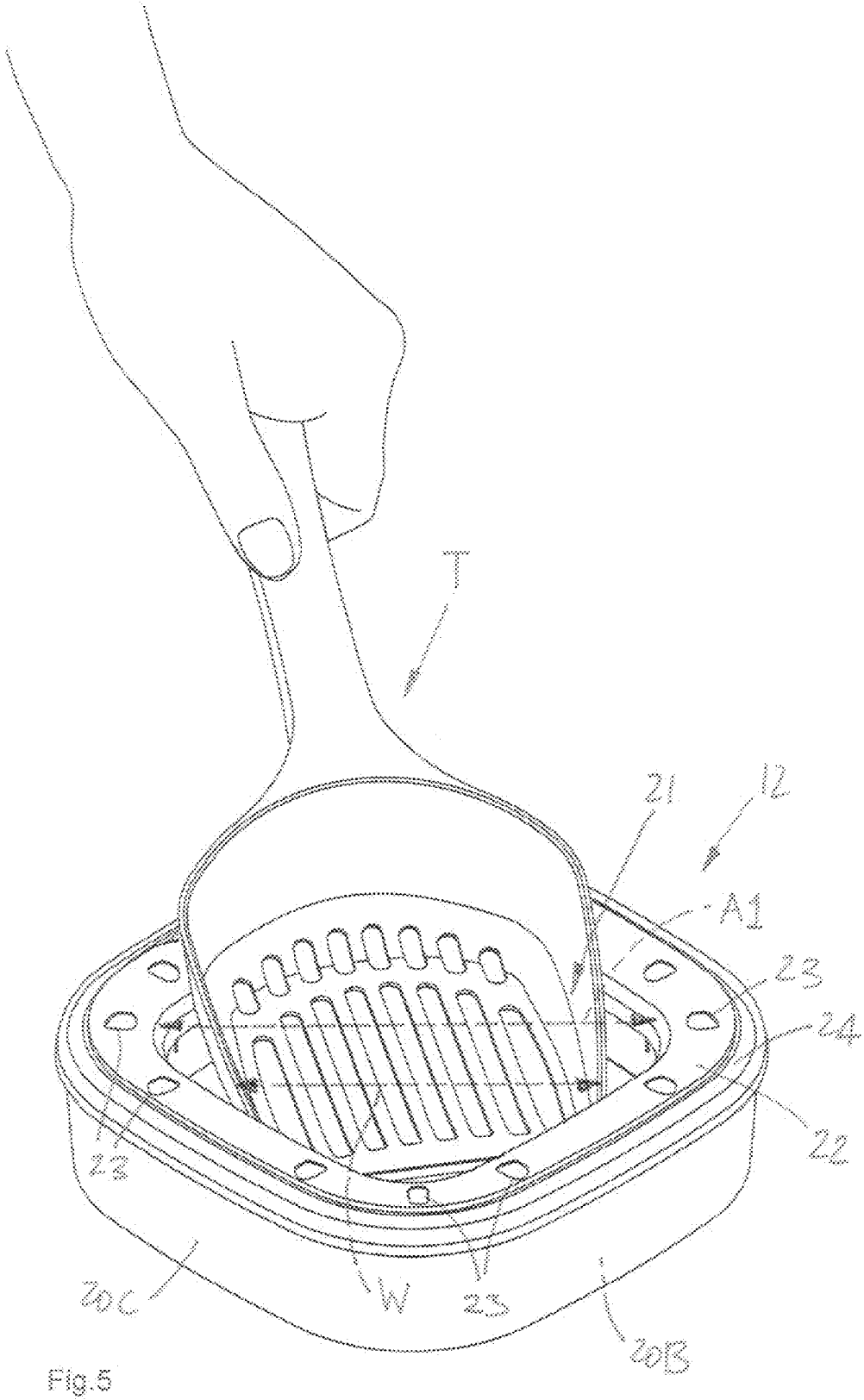
FIG. 5 is a perspective view of the film-dispensing cassette of FIG. 1 as used with a scooping tool.

With A1>A2 outlines, the cassette 12 has a greater amount of tubular film than cassettes without such outlines, for a same minimum axial dimension A2. Moreover, as shown in FIG. 5, cassettes with A1>A2 outlines allow tools T to be fitted into the central opening 21 while minimizing the size of the cassette 12 or rimmed bag 12'. In other words, a cassette without an A1>A2 outline will be of greater dimension than a cassette with A1>A2 outline, if it must receive a tool T in the central opening 21, in the manner shown in FIG. 5. The tool T is illustrated as being a scooping tool, with a width W.

Figure 9:
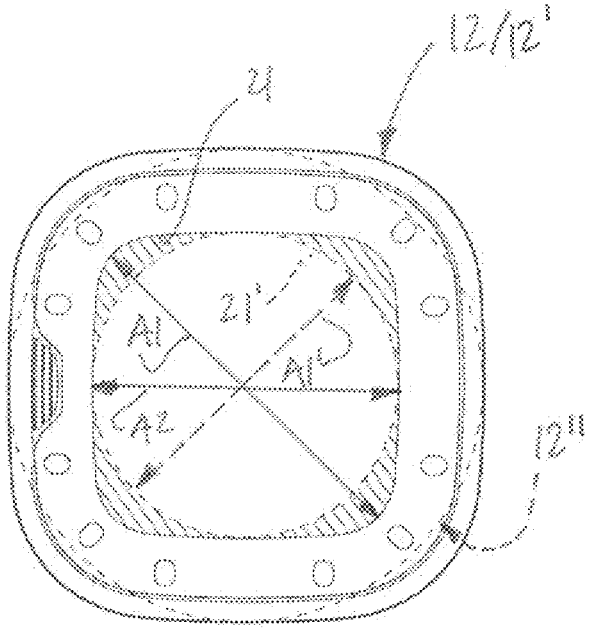
FIG. 9 is a comparative view of the film-dispensing cassette of FIG. 1/rimmed bag of FIG. 8 and of a film-dispensing cassette of the prior art.

Referring to FIG. 9, there is illustrated a comparative view between the cassette 12/rimmed bag 12', and a cassette 12" of the prior art. The cassette 12" does not have an A1'>A2 outline for its central opening 21', but rather an A1'=A2 outline. Therefore, when comparing the cassette 12/rimmed bag 12' with the cassette 12" as superposed in FIG. 8, it is observed that dimension A1 in the cassette 12/rimmed bag 12' is greater than dimension A1' in the cassette 12", for the same minimum axial dimension A2. Accordingly, for similar inner and outer dimensions, the cassette 12 can support more tubular film than the cassette 12". As the outlines of the central opening 12 and of the outer periphery of the cassette 12/rimmed bag 12' are similar figures, the A1, A1' and A2 representations in FIG. 9 are only for the central opening 12 for clarity of illustration, but could also be made for the outer periphery.

According to the arrangement of FIG. 5, a sequence of manipulations is performed to dispose of waste in the bag formed of the tubular film 13 dispensed by the cassette 12/rimmed bag 12'. The tool T is positioned over the central opening 21 of the cassette 12/rimmed bag 12'. The tool T is rotated or oriented such that a width W of the tool is generally parallel to the A1 dimension of the central opening 21. The tool T is then lowered into the central opening 21 with the width W of the tool T remaining generally parallel to the A1 dimension. The tool T is then pivoted approximately about the A1 dimension, or about an axis generally parallel to the A1 dimension, such that waste slides out of the tool T, through the central opening 21, and into the bag of tubular film 13 of the cassette 12/rimmed bag 12'.

The sequence of manipulations is advantageously used when the waste has a volatile solid component, such as dust. For instance, when the waste is cat litter, it is desired to reduce the movement of the cat litter from the scoop T to the bag of tubular film 13, to minimize the creation of dust from the disposal action.

Figure 4C:
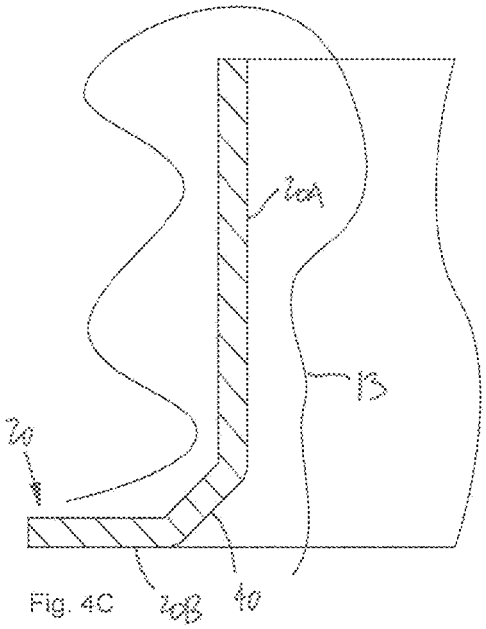
FIG. 4C is a sectional view of an annular body of the film-dispensing cassette of FIG. 1, without outer annular wall and with clearance.
Figure 4D:
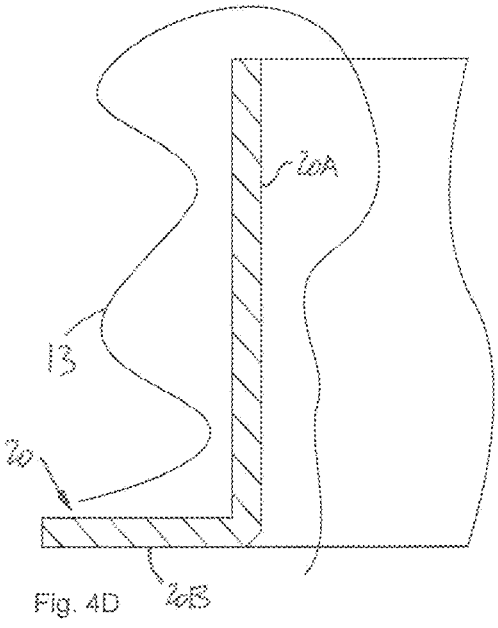
FIG. 4D is a sectional view of an annular body of the film-dispensing cassette of FIG. 1, without outer annular wall and without clearance.

Referring to FIGS. 4A to 4D, various sections considered for the annular body 20 are illustrated, as dispensing the tubular film 13. FIGS. 4A and 4C show a clearance 40. The clearance 40 is used in combination with a projection in the support 13 of the waste-disposal unit 10, to ensure that the cassette 12 is properly inserted into the waste-disposal unit 10. The clearance 40 may also be at the junction of the bottom wall 20B and the outer annular wall 20C, any may take any suitable form, such as screw-in slots (for complementary engagement with retainer tabs), threading, etc. If the cassette 12 dispenses the tubular film 13 from its bottom, the clearance may not be required. According to another embodiment, the bottom wall 20B projects radially inwardly into the central opening 21. In such a case, the bottom wall 20B may serve as a support for the cassette 12.

The invention claimed is:

1. A film-supporting device for use with a waste-disposal unit comprising:

an annular body removably insertable in the waste-disposal unit and having at least an annular wall, with an inward radial surface defining a central opening of the annular body, an outline of the central opening in a transverse plane of the device having variable diametrical dimensions with a first diameter being of greater dimension than a second diameter, the outline having in the transverse plane of the device two of the first diameter of generally equal dimension and two of the second diameter of generally equal dimension, with the first diameter being the maximum diameter of the outline in the transverse plane, and with the second diameter being the minimum diameter of the outline in the transverse plane; and tubular film about an outward radial surface of the annular body, with a free annular end dispensed outwardly from the annular wall, the free annular end being adapted to be closed to form a bag with an opening of the bag being accessible through the central opening.

2. The film-supporting device according to claim 1, wherein the annular wall is an inner annular wall, and the annular body comprises at least one radial wall projecting radially outwardly from the inner annular wall.

3. The film-supporting device according to claim 2, further comprising an outer annular wall projecting upwardly from the radial wall.

4. The film-supporting device according to claim 3, wherein an outer periphery of the annular body as defined by the outer annular wall has an outline geometrically similar to the outline of the central opening.

5. The film-supporting device according to claim 2, further comprising a cover wall projecting radially outwardly from the inner annular wall.

6. The film-supporting device according to claim 5, wherein an outer periphery of the annular body as defined by the cover wall has an outline geometrically similar to the outline of the central opening.

7. The film-supporting device according to claim 5, wherein the cover wall comprises a tear-off portion to access the free end of tubular film.

8. The film-supporting device according to claim 7, further comprising an outer annular wall projecting upwardly from the radial wall.

9. The film-supporting device according to claim 3, further comprising a flange on the outer annular wall, with an undersurface of the flange defining a shoulder for seating the film-supporting device.

10. The film-supporting device according to claim 1, wherein the outline of the central opening is a super-ellipse.

11. The film-supporting device according to claim 10, wherein the outline of the central opening is a squircle.

12. The film-supporting device according to claim 5, wherein the cover wall has a plurality of throughbores spaced apart along a circumference of the cover wall.

* * * * *